US010001137B2

(12) United States Patent
Krewinkel et al.

(10) Patent No.: US 10,001,137 B2
(45) Date of Patent: Jun. 19, 2018

(54) EXHAUST-GAS TURBOCHARGER

(71) Applicant: BorgWarner Inc., Auburn Hills, MI (US)

(72) Inventors: Robert Krewinkel, Kerkrade (NL); Frank Scherrer, Frankenthal (DE)

(73) Assignee: BorgWarner Inc., Auburn Hills, MI (US)

( * ) Notice: Subject to any disclaimer, the term of this patent is extended or adjusted under 35 U.S.C. 154(b) by 382 days.

(21) Appl. No.: 14/402,132

(22) PCT Filed: May 16, 2013

(86) PCT No.: PCT/US2013/041273
§ 371 (c)(1),
(2) Date: Nov. 19, 2014

(87) PCT Pub. No.: WO2013/180960
PCT Pub. Date: Dec. 5, 2013

(65) Prior Publication Data

US 2015/0125265 A1 May 7, 2015

(30) Foreign Application Priority Data

May 29, 2012 (DE) ..... 10 2012 010 539

(51) Int. Cl.
*F04D 29/58* (2006.01)
*F01D 25/14* (2006.01)
(Continued)

(52) U.S. Cl.
CPC ..... *F04D 29/4206* (2013.01); *F01D 25/14* (2013.01); *F01D 25/26* (2013.01);
(Continued)

(58) Field of Classification Search
CPC ..... F05D 2220/40; F05D 2240/14; F05D 2260/232; F05D 2230/21; Y02T 10/144;
(Continued)

(56) References Cited

U.S. PATENT DOCUMENTS 2,866,617 A * 12/1958 Land ..... F01D 25/14 165/134.1
3,614,259 A * 10/1971 Neff ..... F01D 9/026 415/151
(Continued)

FOREIGN PATENT DOCUMENTS

JP 2008267257 A 11/2008

OTHER PUBLICATIONS

International Search Report in International Application No. PCT/US2013/041273 dated Nov. 26, 2013.

*Primary Examiner* — Logan Kraft
*Assistant Examiner* — Joshua R Beebe
(74) *Attorney, Agent, or Firm* — Eric L. Doyle; Stephan A. Pendorf; Patent Central LLC

(57) ABSTRACT

An exhaust-gas turbocharger (1) with 2-channel turbine inflow, including a housing (2), a shaft (6) mounted in the housing (2), a compressor wheel (8) arranged on the shaft (6) and a turbine wheel (7) arranged on the shaft (6), and a first and a second inflow duct (11, 12) formed in the housing (2). Both inflow ducts (11, 12) open in the direction of the turbine wheel (7). A partition (9) separates the two inflow ducts (11, 12) from one another. At least one water-cooling duct (10) is provided in the interior of the partition (9).

11 Claims, 4 Drawing Sheets

Figure 1:
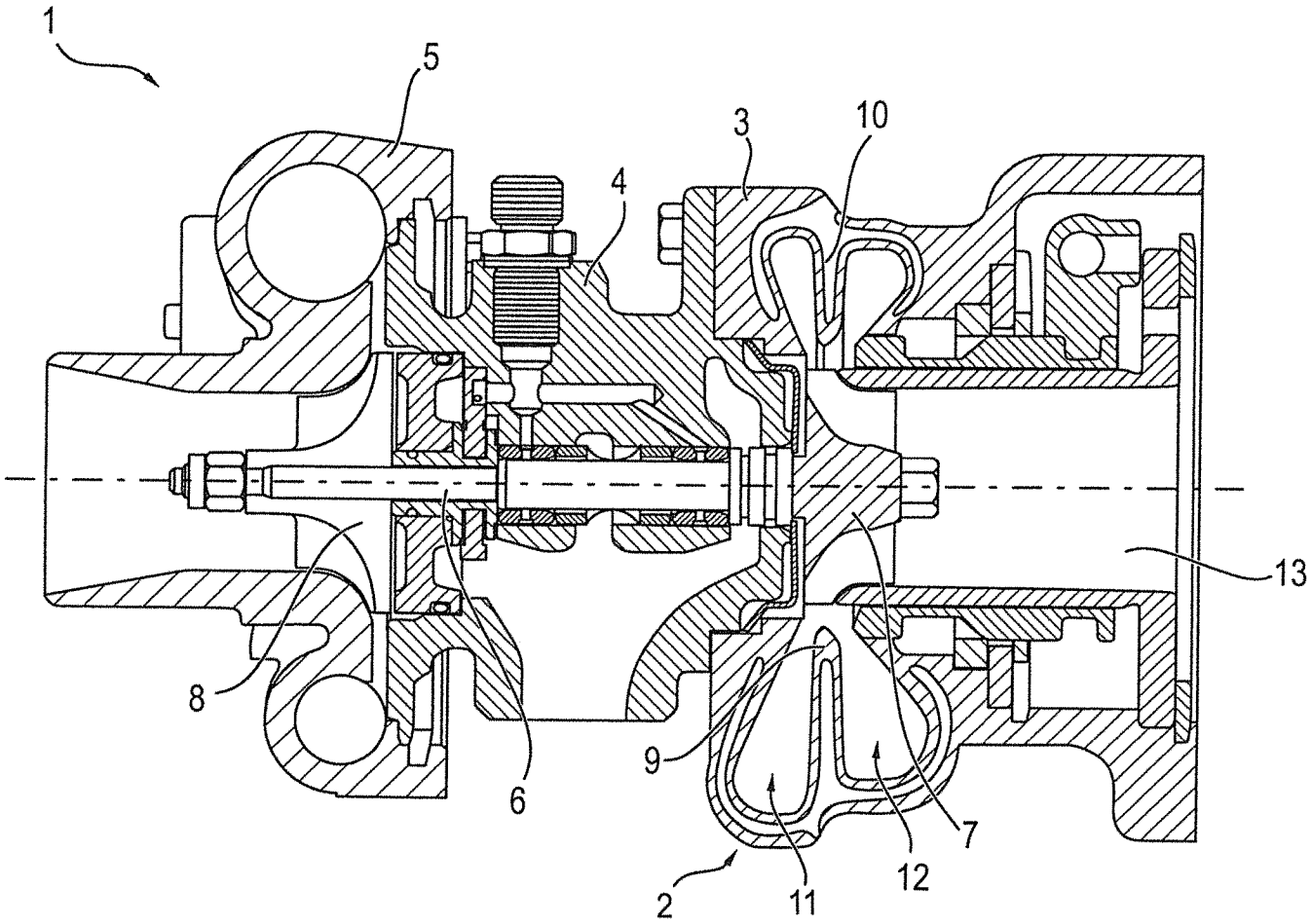

(51) Int. Cl.

| | |
|---|---|
| ***F01D 25/26*** | (2006.01) |
| ***F04D 29/42*** | (2006.01) |
| ***F04D 17/10*** | (2006.01) |
| *F02B 37/02* | (2006.01) |
| *B22C 9/10* | (2006.01) |

(52) U.S. Cl.
CPC ..... *F04D 17/10* (2013.01); *F04D 29/582* (2013.01); *B22C 9/10* (2013.01); *F02B 37/025* (2013.01); *F05D 2230/21* (2013.01); *F05D 2260/232* (2013.01)

(58) Field of Classification Search
CPC ..... F02B 37/18; F02B 37/025; F02C 6/12; F01D 9/026; F01D 17/05; F01D 25/26; F01D 25/12; F01D 25/14; B22C 9/10; F04D 17/10; F04D 29/582; F04D 29/4206; F04D 29/58
See application file for complete search history.

(56) References Cited

U.S. PATENT DOCUMENTS 4,143,994 A * 3/1979 Yamaguchi ..... F01D 9/026 415/205
4,918,923 A * 4/1990 Woollenweber ..... F01N 13/082 123/41.49
5,087,176 A * 2/1992 Wieland ..... F01D 5/025 415/177
5,605,045 A * 2/1997 Halimi ..... F01D 5/085 310/52
6,032,466 A 3/2000 Woollenweber et al.
7,025,579 B2 4/2006 Woollenweber et al.
2002/0085932 A1* 7/2002 Loffler ..... F01D 9/026 417/407
2004/0083730 A1* 5/2004 Wizgall ..... F01D 25/14 60/614
2006/0225419 A1 10/2006 Prusinski et al.
2007/0193268 A1* 8/2007 Noelle ..... F01D 25/14 60/605.1
2007/0271919 A1* 11/2007 Melchior ..... F01L 1/34 60/605.2
2010/0146969 A1* 6/2010 Stiermann ..... F01D 25/14 60/616
2011/0008158 A1* 1/2011 Boening ..... F01D 25/24 415/200
2011/0180026 A1* 7/2011 Heusler ..... F01D 25/14 123/41.44
2011/0252775 A1* 10/2011 Joergl ..... F01D 25/145 60/321

* cited by examiner

EXHAUST-GAS TURBOCHARGER

The invention relates to an exhaust-gas turbocharger according to the preamble of claim 1.

Known from the prior art are exhaust-gas turbochargers in which a 2-channel exhaust-gas supply arrangement is formed in the turbine housing. This is also referred to as a 2-channel turbine inflow or a twin-scroll design. The 2-channel inflow has a thin-walled partition for dividing the gas-conducting spiral into the two inflow ducts. Hot exhaust gas flows around said partition at both sides, and said partition projects radially into the immediate vicinity of the turbine wheel inlet in order to attain the best possible separation effect. Very fast heating of the partition thus occurs, such that faster radial thermal expansion occurs in the partition than in the surrounding walls. Said effect results, in part, in extreme stresses in the partition, which in turn can lead to distortion and cracks as a result of the cyclic loading.

It is an object of the present invention to provide an exhaust-gas turbocharger which, while being inexpensive to produce and operable with low maintenance, permits an operationally reliable 2-channel turbine inflow.

The object is achieved by the features of claim 1. The dependent claims relate to advantageous developments of the invention.

It is provided according to the invention that a water-cooling arrangement is integrated into the interior of the partition. The water-cooling arrangement in the partition which is surrounded at both sides by hot gas leads to a slowed expansion and a reduction of the overall expansion in the partition. As a result of the reduction of the material temperature in the turbine housing, it is possible to use an inexpensive material (for example GJV or aluminum). In this way, it is possible to attain a significant cost reduction in relation to conventional steel housings.

The two inflow ducts extend in the housing from an exhaust-gas inlet to the mouth thereof at the turbine wheel. The two inflow ducts are separated by the partition over this entire length. It is preferably provided that the cooling duct is formed in the interior of the partition also over this entire length in order to effectively prevent excessive heating of the partition.

In certain types of exhaust-gas turbochargers, wastegate ducts branch off from the inflow ducts. Said wastegate ducts lead, bypassing the turbine wheel, directly into an exhaust-gas outlet of the turbocharger. It is preferable for a separate wastegate duct to be provided for each of the two inflow ducts. Said two wastegate ducts must also be separated from one another. It is therefore preferable for the partition to extend in between said two wastegate ducts. To achieve effective cooling here, the water-cooling duct is also provided in the interior of the partition between the two wastegate ducts.

The two inflow ducts and the partition must be dimensioned and positioned such that the water-cooling duct can be formed in the interior of the partition. For thermodynamic reasons, it is preferably provided that the partition and therefore also the water-cooling duct, as viewed in cross section, taper in the direction of the shaft. Said cross section is defined in a plane which runs parallel through the shaft. In particular, for the definition of the tapering, the width of the partition is measured. Said width is measured along a line parallel to the shaft. Here, the width is measured only where said line intersects both the first and also the second inflow duct. It is specifically at these points that the partition can be clearly identified and distinguished from the other housing components. It is preferable for the width of the partition to decrease from the outside to the inside by at least 20%, preferably at least 30%. As a result of the tapering defined in this way, adequate installation space for the water-cooling duct is provided.

Figure 2:
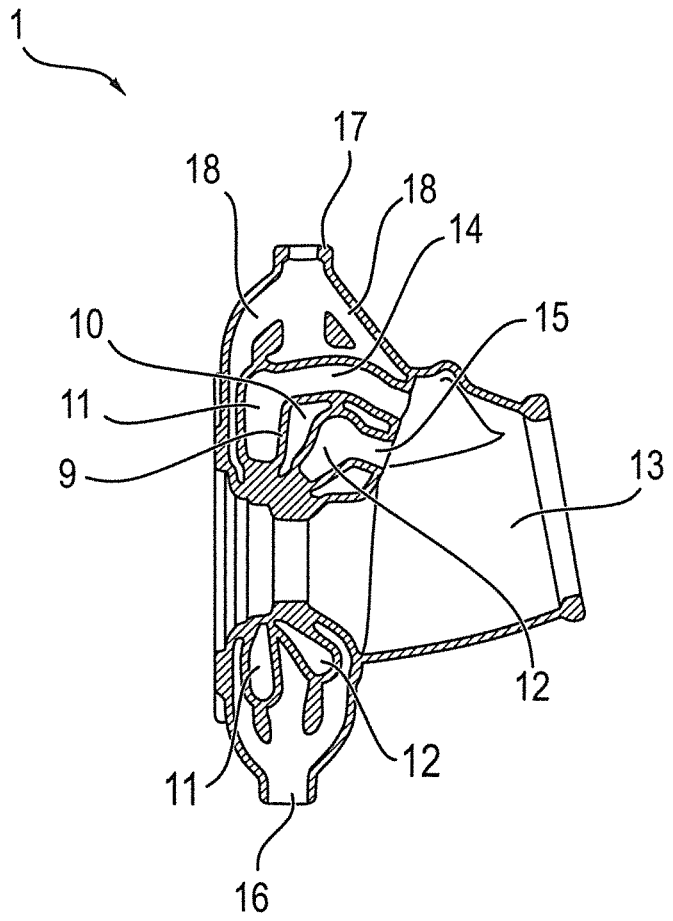
Figure 3:
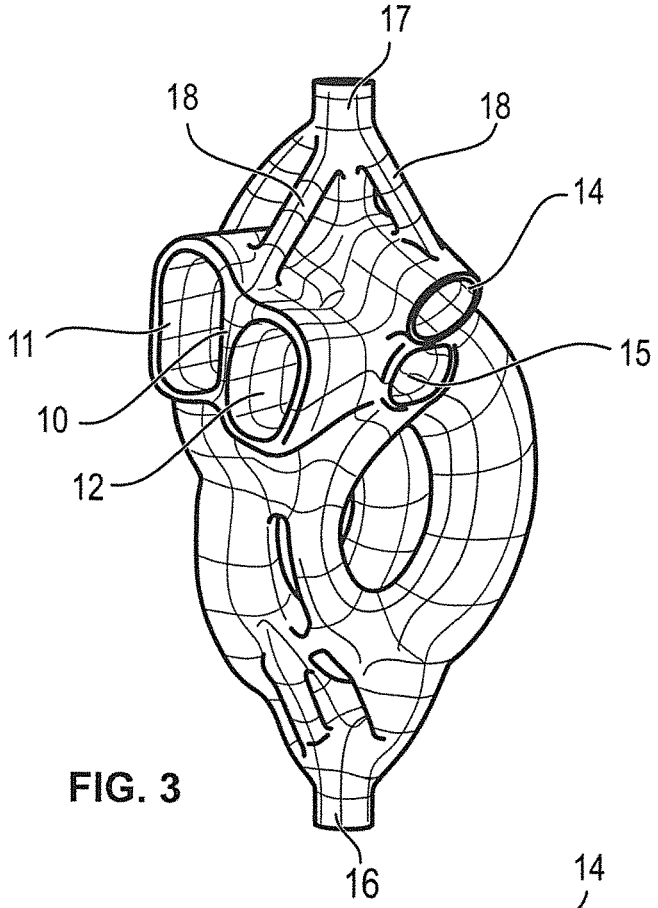
Figure 4:
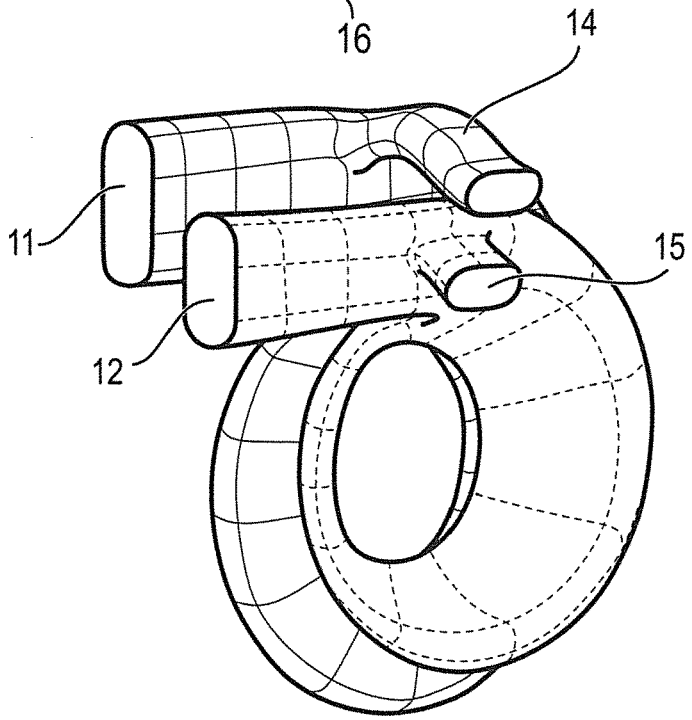
Figure 5:
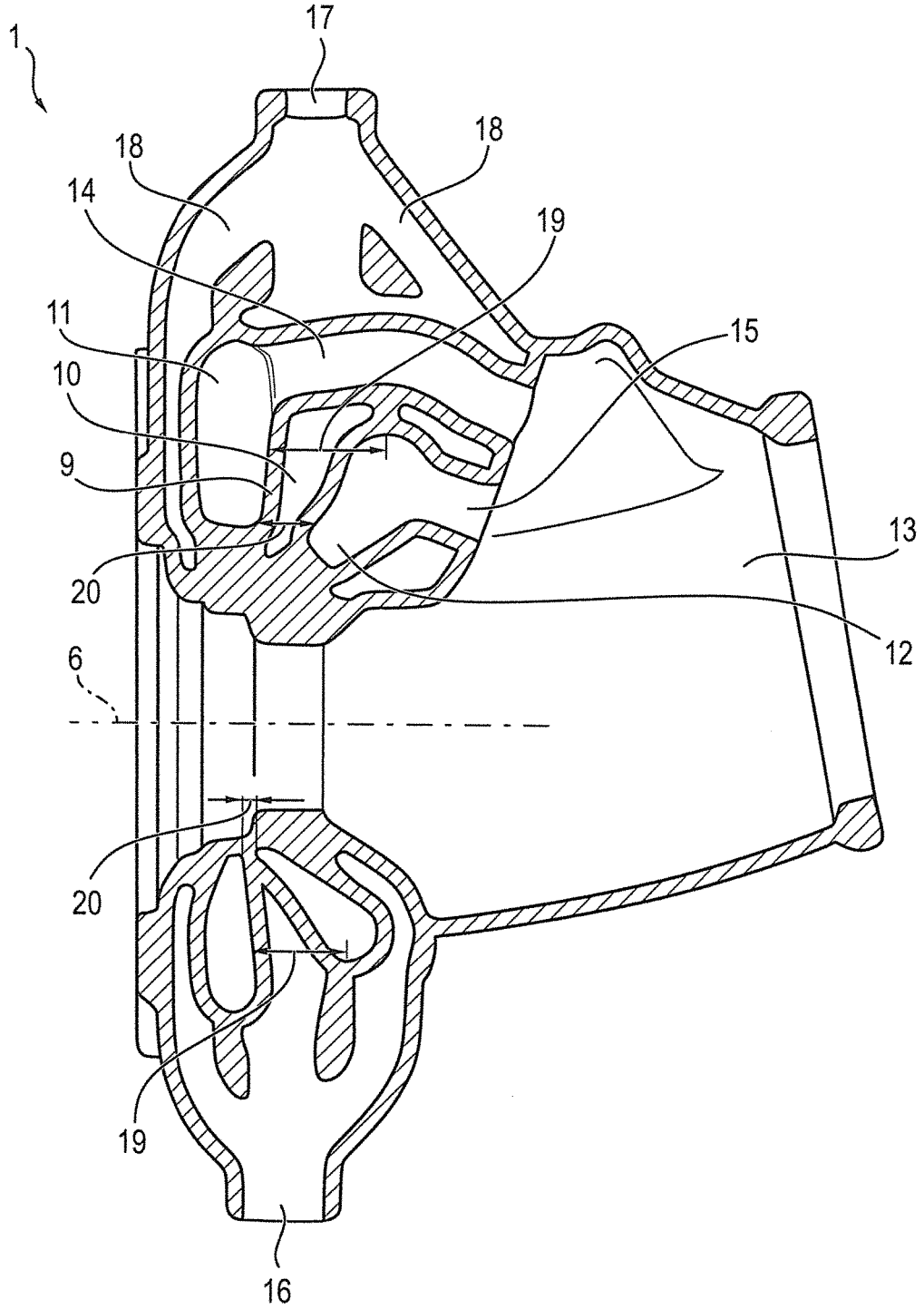

Further details, advantages and features of the present invention become apparent from the following description of the exemplary embodiment with reference to the drawing, in which:

FIG. 1 shows an exhaust-gas turbocharger according to the invention as per an exemplary embodiment, FIG. 2 shows a detail from FIG. 1, FIG. 3 shows a water core of the water-cooling arrangement of the exhaust-gas turbocharger according to the invention as per the exemplary embodiment, FIG. 4 shows a gas flow core of the exhaust-gas turbocharger according to the invention as per the exemplary embodiment, and FIG. 5 is an enlarged illustration of FIG. 2.

An exemplary embodiment of the exhaust-gas turbocharger 1 will be described in detail below on the basis of FIGS. 1 to 5.

FIG. 1 shows, in a simplified schematic illustration, a section through the entire exhaust-gas turbocharger 1. The exhaust-gas turbocharger 1 comprises a housing 2. Said housing 2 is assembled from a turbine housing 3, a bearing housing 4 and a compressor housing 5. A shaft 6 is mounted in the housing 2. A turbine wheel 7 and a compressor wheel 8 are seated in a rotationally conjoint manner on the shaft 6. The turbine wheel 7 is impinged on by flow of exhaust gas and thus sets the shaft 6 and the compressor wheel 8 in rotation. Charge air for an internal combustion engine is compressed by means of the compressor wheel 8.

A first inflow duct 11 and a second inflow duct 12 are formed in the housing 2, in particular in the turbine housing 3. Said two inflow ducts 11, 12 constitute a 2-channel turbine inflow. The two inflow ducts 11, 12 are separated from one another by a partition 9. The partition 9 is an integral constituent part of the housing 2, in particular of the turbine housing 3. A water-cooling duct 10 is formed in the interior of the partition 9. Said water-cooling duct 10 of the partition 9 is fluidically connected to further water-cooling ducts for the housing 2.

The exhaust gas flows via the two inflow ducts 11, 12 to the turbine wheel 7 and exits the exhaust-gas turbocharger 1 via an exhaust-gas outlet 13.

FIG. 2 shows a detail of the exhaust-gas turbocharger 1. The illustration shows a section through the turbine housing 3. For the sake of clarity, the shaft 6 and the turbine wheel 7 are not shown.

FIG. 2 shows that a first wastegate duct 14 branches off from the first inflow duct 11. A second wastegate duct 15 likewise branches off from the second inflow duct 12. The two wastegate ducts 14, 15 constitute a direct connection, bypassing the turbine wheel 7, between the inflow ducts 11, 12 and the exhaust-gas outlet 13. The partition 9 and the water-cooling duct 10 formed in the interior of the partition 9 extend between the two wastegate ducts 14, 15.

The water supply to the water-cooling duct 10 takes place via a central water inflow duct 16. The discharge of the water takes place via a central water outflow duct 17. The central water inflow duct 16 and the central water outflow duct 17 are utilized for the water supply to the entire housing 2, in particular to the entire turbine housing 3. Secondary ducts 18 therefore branch off from the central water inflow duct 16 and central water outflow duct 17.

FIG. 3 shows the so-called "water core" for the exhaust-gas turbocharger 1. The geometry illustrated in FIG. 3 is, in the finished exhaust-gas turbocharger 1, a water-filled cavity. The "water core" illustrated in FIG. 3 may thus be regarded as part of a casting mold for the housing 2. FIG. 3 shows the central water inflow duct 16 at the bottom and the central water outflow duct 17 at the top. It is particularly preferable for the water to be supplied from below and discharged at the top, such that any bubbles and air inclusions can exit the water-cooling arrangement. From the central water outflow duct 17 there branches off at least one secondary duct 18 which leads directly into the water-cooling duct 10 in the partition 9. A continuous and low-loss flow through all of the water-cooling ducts is thereby ensured.

The central water inflow duct 16 and the central water outflow duct 17 can be distinguished from the secondary ducts 18 in that the secondary ducts 18 have a smaller diameter than the central water inflow duct 16 and the central water outflow duct 17.

FIG. 4 shows a so-called "gas flow core". The geometry illustrated in FIG. 4 is, in the finished exhaust-gas turbocharger 1, a cavity in which the exhaust gas flows. It can be seen how the two inflow ducts 11, 12 run parallel and approach the turbine wheel 7 in spiral form. The partition 9 with its water-cooling arrangement 10 is formed over the entire length of the two inflow ducts 11, 12.

FIG. 5 is an enlarged view from FIG. 2. In FIG. 5, the position of the shaft 6 is indicated. The width of the partition 9 is measured parallel to the shaft 6. Reference sign 19 denotes a first width of the partition 9. Reference sign 20 denotes a second width of the partition 9. The partition 9 is defined at least between said two widths 19, 20. The two widths 19, 20 are measured on lines, wherein said lines are arranged parallel to the shaft 6 and intersect both the first inflow duct 11 and also the second inflow duct 12. The second width 20 is at least 20% shorter than the first width 19. In this way, adequate tapering of the partition 9, or an adequate spacing of the two inflow ducts 11, 12 in the region of the first width 19, is provided in order to allow the water-cooling arrangement 10 to be positioned in the interior of the partition 9.

In addition to the above written description of the invention, reference is hereby explicitly made to the diagrammatic illustration of the invention in FIGS. 1 to 5 for additional disclosure thereof.

LIST OF REFERENCE SIGNS

1 Exhaust-gas turbocharger
2 Housing
3 Turbine housing
4 Bearing housing
5 Compressor housing
6 Shaft
7 Turbine wheel
8 Compressor wheel
9 Partition
10 Water-cooling duct in the interior of the partition
11 First inflow duct
12 Second inflow duct
13 Exhaust-gas outlet
14 First wastegate duct
15 Second wastegate duct
16 Central water inflow duct
17 Central water outflow duct
18 Secondary ducts
19 First width
20 Second width

The invention claimed is:

1. An exhaust-gas turbocharger (1) with 2-channel turbine inflow, comprising
- a turbine housing (2),
- a shaft (6) mounted in the housing (2),
- a compressor wheel (8) arranged on the shaft (6) and a turbine wheel (7) arranged on the shaft (6),
- a first and a second exhaust gas inflow duct (11, 12) formed in the turbine housing (2), wherein both exhaust gas inflow ducts (11, 12) open in the direction of the turbine wheel (7),
- a partition (9) which separates the first and the second exhaust gas inflow ducts (11, 12) from one another,
- a water inflow duct (16) for supplying water to the turbine housing (2),
- a water outflow duct (17) at the top of the turbine housing (2) for discharge of water from the turbine housing (2), and
- at least one water-cooling duct (10) in the interior of the partition (9) fluidically connected to the central water inflow duct (16) and the central water outflow duct (17) of the turbine housing (2).

2. The exhaust-gas turbocharger as claimed in claim 1, wherein the partition (9) is an integral constituent part of the housing (2).

3. The exhaust-gas turbocharger as claimed in claim 1, wherein the two inflow ducts (11, 12) begin at an exhaust-gas inlet on the housing (2) and approach the turbine wheel (7) in spiral form, wherein the partition (9) is formed over the entire length of the two inflow ducts (11, 12).

4. The exhaust-gas turbocharger as claimed in claim 3, wherein the water-cooling duct (10) is formed in the interior of the partition (9) over the entire length of the partition (9).

5. The exhaust-gas turbocharger as claimed in claim 1, further comprising a first wastegate duct (14), which branches off from the first inflow duct (11), and a second wastegate duct (15), which branches off from the second inflow duct (12), wherein the partition (9) is continued between the two wastegate ducts (14, 15).

6. The exhaust-gas turbocharger as claimed in claim 1, wherein, in a cross section defined parallel through the shaft (6), the partition (9) and the water-cooling duct (10) taper in the direction of the shaft (6).

7. The exhaust-gas turbocharger as claimed in claim 6, wherein, in the cross section, the width (19, 20) of the partition (9), defined parallel to the shaft (6), decreases by at least 20%.

8. The exhaust-gas turbocharger as claimed in claim 6, wherein, in the cross section, the width (19, 20) of the partition (9), defined parallel to the shaft (6), decreases by at least 30%.

9. The exhaust-gas turbocharger as claimed in claim 1, wherein the central water inflow duct (16) is at the bottom of the turbine housing (2).

10. An exhaust-gas turbocharger (1) with 2-channel turbine inflow, comprising
- a turbine housing (2),
- a shaft (6) mounted in the housing (2),
- a compressor wheel (8) arranged on the shaft (6) and a turbine wheel (7) arranged on the shaft (6),
- a first and a second exhaust gas inflow duct (11, 12) formed in the turbine housing (2), wherein both exhaust gas inflow ducts (11, 12) open in the direction of the turbine wheel (7), a partition (9) which separates the first and the second exhaust gas inflow ducts (11, 12) from one another, a central water inflow duct (16) for supplying water to the turbine housing (2), a central water outflow duct (17) at the top of the turbine housing (2) for discharge of water from the turbine housing (2), at least one water-cooling duct (10) in the interior of the partition (9) fluidically connected to the central water inflow duct (16) and the central water outflow duct (17) of the turbine housing (2), and a first wastegate duct (14), which branches off from the first inflow duct (11), and a second wastegate duct (15), which branches off from the second inflow duct (12), wherein the partition (9) is continued between the two wastegate ducts (14, 15), and wherein the water-cooling duct (10) is formed between the two wastegate ducts (14, 15) in the interior of the partition (9).

11. An exhaust-gas turbocharger (1) with 2-channel turbine inflow, comprising a turbine housing (2), a shaft (6) mounted in the housing (2), a compressor wheel (8) arranged on the shaft (6) and a turbine wheel (7) arranged on the shaft (6), a first and a second exhaust gas inflow duct (11, 12) formed in the turbine housing (2), wherein both exhaust gas inflow ducts (11, 12) open in the direction of the turbine wheel (7), a partition (9) which separates the first and the second exhaust gas inflow ducts (11, 12) from one another, a water inflow duct (16) for supplying water to the turbine housing (2), a water outflow duct (17) at the top of the turbine housing (2) for discharge of water from the turbine housing (2), and at least one water-cooling duct (10) in the interior of the partition (9) fluidically connected to the central water inflow duct (16) and the central water outflow duct (17) of the turbine housing (2), wherein a central water outlet duct (17) on the housing (2) and a plurality of secondary ducts (18) issue into the central water outlet duct (17), wherein one of the secondary ducts (18) directly connects the water-cooling duct (10) in the interior of the partition (9) to the central water outlet duct (17).

* * * * *